US007056090B1

(12) United States Patent
Stengel

(10) Patent No.: US 7,056,090 B1
(45) Date of Patent: Jun. 6, 2006

(54) CEILING FAN BLADE COVER

(76) Inventor: Kathleen Stengel, 15450 Nisqualli Rd. R101, Victorville, CA (US) 92392

( * ) Notice: Subject to any disclaimer, the term of this patent is extended or adjusted under 35 U.S.C. 154(b) by 0 days.

(21) Appl. No.: 10/822,009

(22) Filed: Apr. 9, 2004

Related U.S. Application Data

(60) Provisional application No. 60/461,518, filed on Apr. 9, 2003.

(51) Int. Cl.
*F01D 5/00* (2006.01)

(52) U.S. Cl. ..... 416/62
(58) Field of Classification Search ..... 416/62, 416/146 R, DIG. 4, DIG. 3
See application file for complete search history.

(56) References Cited

U.S. PATENT DOCUMENTS

| | | | | |
|---|---|---|---|---|
| 4,676,721 | A | 6/1987 | Hardee | 416/146 |
| 5,281,093 | A | 1/1994 | Sedlak | 416/62 |
| 5,947,686 | A | 9/1999 | Keyes | 416/61 |
| 6,015,261 | A * | 1/2000 | Barone | 416/62 |
| 6,019,479 | A | 2/2000 | Barker | 362/96 |
| 6,619,920 | B1 * | 9/2003 | Cannon | 416/62 |

* cited by examiner

*Primary Examiner*—Edward K. Look
*Assistant Examiner*—Nathan Wiehe
(74) *Attorney, Agent, or Firm*—Goldstein Law Offices P.C.

(57) ABSTRACT

A ceiling fan blade cover for positioning over a fan blade. The cover has a covering portion and a plurality of strategically positioned adhesive strips. The covering portion is wrapped around the blade, and the adhesive strips adhere the cover to itself around the blade. A perforated strip along the cover splits the cover longitudinally to allow the cover to be easily removed from the blade.

2 Claims, 2 Drawing Sheets

CEILING FAN BLADE COVER

CROSS REFERENCES AND RELATED SUBJECT MATTER

This application claims the benefit of provisional patent application Ser. No. 60/461,518, filed in the United States Patent Office on Apr. 9, 2003.

BACKGROUND OF THE INVENTION

The invention relates to a ceiling fan blade cover. In particular, the invention is a cover that is placed around a fan blade for shielding the blade from dust and dirt. The cover is wrapped around the blade and may be easily removed therefrom in order to be replaced with a new cover.

Ceiling fans are utilized in many homes and businesses as a means of providing circulation of air with the surrounding area. The fans also provide an energy efficient means of cooling a room. However, along with the air circulation, the ceiling fan also has a tendency to distribute dust and allergens. When stationary, the blades of the fan provide a surface on which dust may settle. Upon activation of the fan, the blades cause the accumulated dust and allergens to be spread around the room. This may reduce the air quality in the surrounding area, thereby causing breathing difficulties, eye irritations, and nasal congestion to persons in the room.

Further, because of the location of the ceiling fan, namely close to the ceiling, it is difficult to clean the fan and the blades on a regular basis. Most people would require a ladder or stool to reach the top surfaces of the blades to properly dust and clean said surfaces. Consequently, this is not a task that is performed on a daily basis.

Thus, there exists a need for a ceiling fan blade cover that is placed over the blades of a ceiling fan. The covers are easily installed and replaced, as necessary. Further, the blade covers may have various ornamental designs printed thereon to enhance the appearance of the ceiling fan according to the user's preference.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved ceiling fan-blade covers. As such, the general purpose of the present invention, which will be described subsequently in greater detail, is to provide a new and improved ceiling fan blade covers which has all the advantages of the prior art and none of the disadvantages.

To attain this, the present invention essentially comprises a ceiling fan blade cover for positioning over a fan blade. The cover has a covering portion and a plurality of strategically positioned adhesive strips. The covering portion is wrapped around the blade, and the adhesive strips adhere the cover to itself around the blade. A perforated strip along the cover splits the cover longitudinally to allow the cover to be easily removed from the blade.

It is an object of the invention to produce a ceiling fan blade cover that protects the fan blade from accumulation of dust and dirt thereon. Accordingly, the blade cover is constructed to fit snugly over the existing fan blade. The cover may be easily replaced with a new cover once dust and allergens have settled thereon.

It is a further object of the invention to produce a ceiling fan blade cover that provides an ornamental design to an the blades of an existing ceiling fan. Accordingly, the portion of the cover that extends over the bottom surface of the fan blade has an ornamental design printed thereon.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
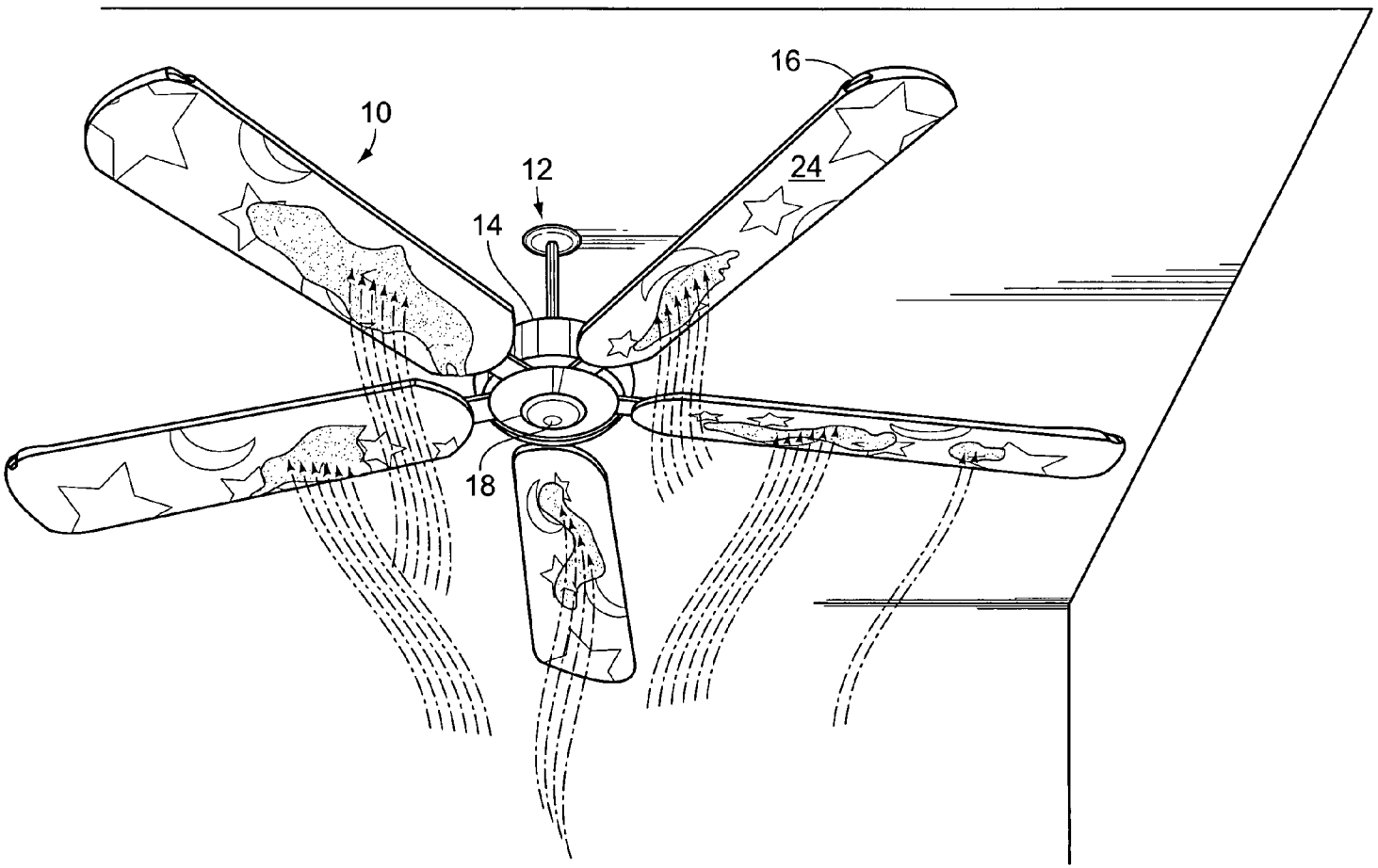
FIG. 1 is a perspective view of a plurality of ceiling fan blade covers in place around the blades of a ceiling fan.

10 ceiling fan blade cover
12 ceiling fan
14 fan central housing
16 fan blade
16T fan blade top surface
16B fan blade bottom surface
18 fan motor
20 covering portion
22 adhesive strips
24 covering portion outer surface
25 tongue outer end
26 covering portion inner surface
28 main panel
28F main panel forward end
28R main panel rear end
28S main panel side edge
30 side flap
32 tongue
34 tab
36 crease
38 adhesive strip liner
40 tongue perforated strip
42 perforated strip pull-tab

DETAILED DESCRIPTION OF THE PREFERRED EMBODIMENTS

FIG. 1 illustrates a standard ceiling fan 12, having a central housing 14 from which a plurality of blades 16 extend longitudinally. A motor 18 is cased within the housing 14, said motor 18 being in communication with the blades 16 and causing horizontal rotation of said blades 16 upon activation of the motor 18. Each blade 16 has a top surface 16T that is oriented upward towards a ceiling, and a bottom surface 16B that is oriented downward.

According to the present invention, a plurality of blade covers 10 are provided. Each of the blade covers 10 extend over one of the individual fan blades 16, thereby protecting the blades 16 from dirt and dust settling thereon, as well as providing an aesthetically pleasing appearance. Each blade cover 10 essentially comprises a covering portion 20 and a plurality of adhesive strips 22, said strips 22 strategically positioned along the covering portion 20 for securing said covering portion 20 onto the fan blade 16 and onto itself to encase the fan blade 16.

Figure 2:
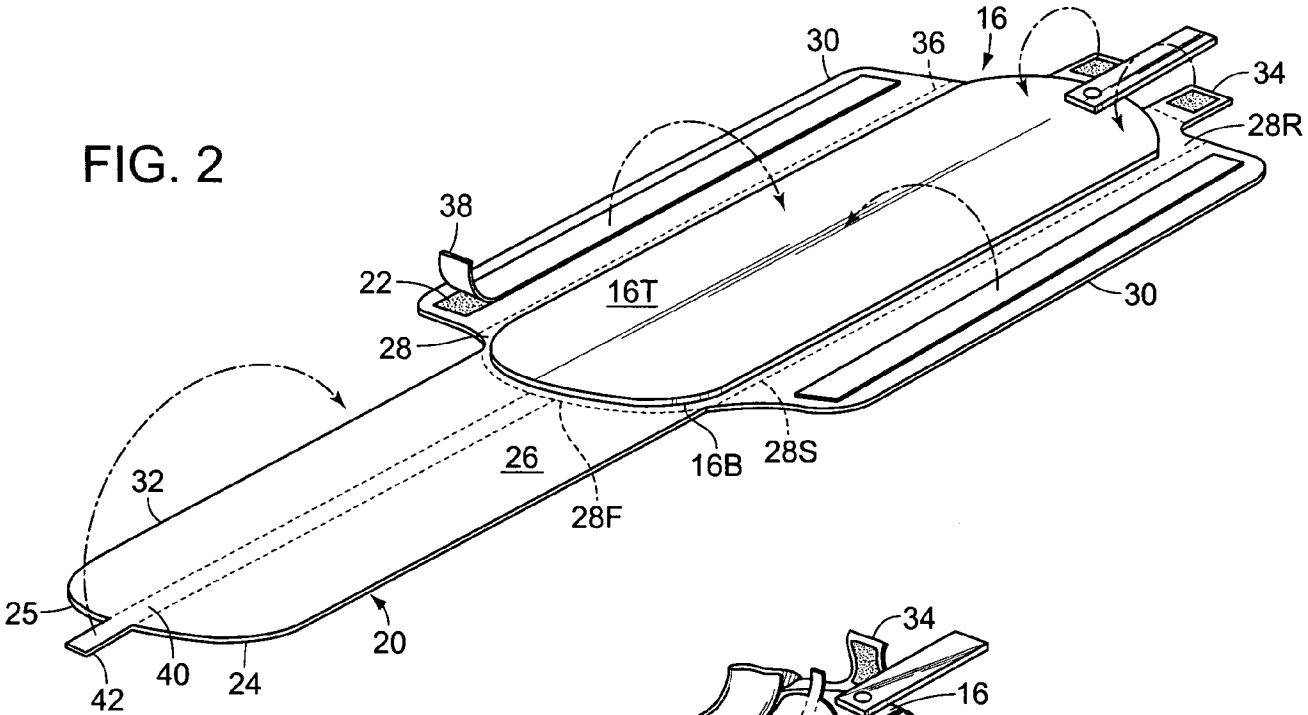
FIG. 2 is a perspective view of an unfolded blade cover positioned under a fan blade, illustrating application of the cover around the blade.
Figure 3:
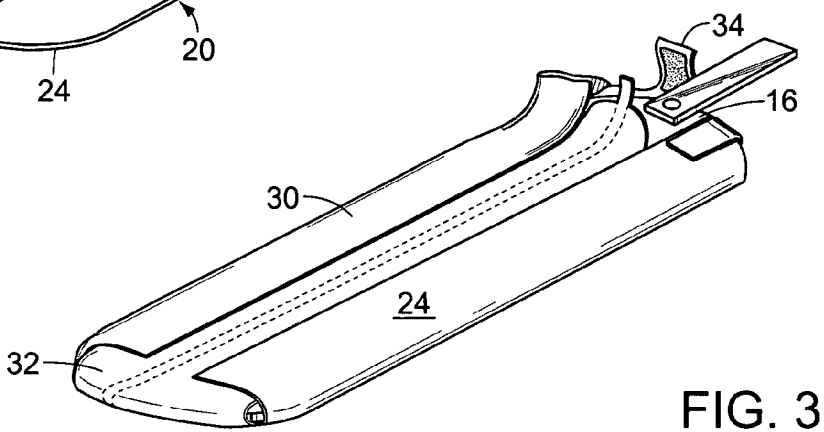
FIG. 3 is a perspective view of a blade cover wrapped around a fan blade.

The covering portion 20 is initially flat but sized to fit snugly around the fan blade 16 when properly folded and has an outer surface 24 and an inner surface 26, wherein the inner surface 26 is pressed against the blade 16. As illustrated in FIG. 2, the covering portion 20 comprises a main panel 28, a pair of side flaps 30, a tongue 32, and a pair of tabs 34. When properly positioned over the blade 16, the main portion 28 extends beneath the blade bottom surface 16B, and the tongue 32, flaps 30, and tabs 34 wrap over the blade top surface 16T. Thus, creases 36 extend between the main panel 28 and the tongue 32, flaps 30, and tabs 34. These creases 36 allow the covering portion 20 to fold immediately adjacent to the blade 16 to wrap around the blade 16.

The main panel 28 has a forward end 28F, a rear end 28R, and a pair of side edges 28S extending between the ends 28F, 28R. The tongue 32 extends longitudinally from the main panel forward end 28F, and has an outer edge 25 fully opposite therefrom. The pair of tabs 34 extend outward from the main panel rear end 28R, opposite the tongue 32. Each tab 34 is positioned near one of the main panel side edges 28S. One of the adhesive strips 22 is positioned on each of the tabs 34, on the inner surface 26. When the tongue 32 is folded over the top surface 16T of the blade 16, the tabs 34 extend over the tongue 32, and the adhesive strip 22 adheres the tabs 34 near the outer edge 25 of the tongue 32, thereby securing the tongue 32 in place over the blade 16.

The covering portion side flaps 30 extend outward from the main panel side edges 28S, each flap 30 having one of the adhesive strips 22 positioned longitudinally along the inner surface 26. When folded inward along the crease 36, the side flaps 30 are situated over the outer surface 24 of the tongue 32. The adhesive strips 22 hold the flaps 30 in place over the tongue 32, thereby securing the covering portion 20 to the blade 16. Accordingly, when fully attached, the covering portion 20 is secured onto the blade 16, but is not actually adhered to a portion of the blade 16. Thus, the finish of the blade 16 is protected from damage.

The covering portion tongue 32 further has a perforated strip 40 that extends longitudinally along the length of the tongue 32, preferably down the center thereof. A pull-tab 42 is positioned at one end of the perforated strip 40, thereby allowing a user to tear the tongue 32 along said strip 40. Accordingly, when it is desired to remove the cover 10, the strip 40 is torn and the cover 10 is split longitudinally so that the blade cover 10 may be easily removed from the blade 16. A new clean cover 10 may then be applied to the blade 16, as desired.

Non-adhesive liners 38 are positioned over the adhesive strips 22 along the covering portion 20. These liners 38 prevent the adhesive strips 22 from inadvertently sticking to an unintended surface. Once the cover 10 is ready to be wrapped around the blade 16, the appropriate liners 38 may be removed from the strips 22 in order to secure the covering portion 20 in place.

Additionally, as illustrated in FIG. 1, ornamental designs may be printed on the outer surface 24 of the main panel 28. The main panel 28 is readily visible by the occupants of a room, as it is the portion of the cover 10 that is oriented downward towards the room.

The ceiling fan blade cover 10 is preferably constructed from a lightweight material, namely paper or thin plastic. Such a material is easily folded around the blade 16 and may be effortlessly removed therefrom.

In use, the blade cover 10 to be wrapped around the fan blade 16 is chosen based on the size of the blade 16 and the preferred ornamental design. The inner surface 26 of the main panel 28 is pressed against the bottom surface 16B of the blade 16 and the tongue 32 is folded upward along the crease 36. Once the inner surface 26 of the tongue 32 is laid against the blade top surface 16T, the tab adhesive strip liners 38 are removed from the adhesive strips 22 on the tabs 34, and the tabs 34 are pressed against the outer surface 24 of the tongue 32. The side flaps 30 are then folded upward along the creases 36, and the liners 38 are removed from the adhesive strips 22 thereon. The inner surfaces 26 of said flaps 30 are pressed against the outer surface 24 of the tongue 32, thereby securing the blade cover 10 to the blade 16.

To remove the cover 10 from the blade 16, the user grips the pull-tab 42 extending from the tongue 32 and tears the tongue 32 along the perforated strip 40. The soiled cover 10 may then be easily removed from the blade 16 for disposal and a new, clean cover 10 may be applied.

In conclusion, herein is presented a ceiling fan blade cover which effectively covers a fan blade without actually adhering to any surface thereof. The invention is illustrated by example in the drawing figures, and throughout the written description. It should be understood that numerous variations are possible, while adhering to the inventive concept. Such variations are contemplated as being a part of the present invention.

What is claimed is:

1. A ceiling fan blade cover, for use with a ceiling fan having a fan central housing and a plurality of fan blades, each fan blade having a fan blade top surface and a fan blade bottom surface, comprising:

a main panel having a forward end, a rear end, and a pair of side edges;

a pair of side flaps, each extending outwardly from one of the main panel side edges, wherein the side flaps each have an adhesive strip positioned longitudinally thereon;

a tongue extending longitudinally from the main panel front end, wherein the tongue has a perforated strip extending longitudinally along the tongue and a pull-tab positioned at one end of the perforated strip, thereby allowing a user to remove the fan blade cover from the blade by tearing the tongue along the perforated strip;

a pair of tabs extending outwardly from the main panel rear end, opposite from the tongue, wherein each of the tabs has an adhesive tab for securing the tabs to the side flaps; and wherein to encase one of the fan blades the main portion extends beneath the blade bottom surface, the tongue wraps over the top surface, the side flaps wrap over the blade top surface and attach to the tongue, and the tabs extend over the top surface and attaches to the side flaps.

2. A method of covering a ceiling fan blade, for use with a ceiling fan having a fan central housing and a plurality of fan blades, each fan blade having a fan blade top surface and a fan blade bottom surface, using a cover having a main panel having a forward end, a rear end, and a pair of side edges, a pair of side flaps, each side flap extending outwardly from one of the main panel side edges, a tongue extending longitudinally from the main panel front end, and a pair of tabs extending outwardly from the main panel rear end, opposite from the tongue, comprising the steps of:

extending the main panel of the cover against the bottom surface of the blade with the tongue extending away from the fan central housing;

folding the tongue upwardly and over the blade top surface;

folding the side flaps over the blade top surface and adhering the side flaps to the tongue, wherein the tongue has a perforated strip extending longitudinally thereon and a pull-tab attached to the perforated strip;

folding the tabs over the blade top surface and adhering the tabs to the side flaps; and removing the fan blade cover, when desired, by tearing the tongue by pulling the pull-tab.

* * * * *